US008142736B2

(12) United States Patent
Qian

(10) Patent No.: US 8,142,736 B2
(45) Date of Patent: Mar. 27, 2012

(54) REACTION BOTTLE WITH PRESSURE RELEASE

(75) Inventor: Weimin Qian, Waterford, CT (US)

(73) Assignee: Weimin Qian, Mequon, WI (US)

( * ) Notice: Subject to any disclaimer, the term of this patent is extended or adjusted under 35 U.S.C. 154(b) by 1231 days.

(21) Appl. No.: 11/853,915

(22) Filed: Sep. 12, 2007

(65) Prior Publication Data

US 2009/0065465 A1 Mar. 12, 2009

(51) Int. Cl.
*B01L 3/00* (2006.01)

(52) U.S. Cl. ..... 422/500; 422/501; 422/547; 422/570; 436/180; 73/1.73

(58) Field of Classification Search ..... 422/500–501, 422/547, 570; 436/180; 73/1.73
See application file for complete search history.

(56) References Cited

U.S. PATENT DOCUMENTS

| | | | | |
|---|---|---|---|---|
| 396,708 | A | 1/1889 | Payne | |
| 2,819,820 | A | 1/1958 | Allen | |
| 3,682,315 | A | 8/1972 | Haller | |
| 3,707,239 | A | 12/1972 | Harris | |
| 3,900,028 | A | 8/1975 | McPhee | |
| 4,256,106 | A | 3/1981 | Shoor | |
| 4,480,424 | A | 11/1984 | Seldon | |
| 4,768,568 | A * | 9/1988 | Fournier et al. | 141/286 |
| 5,032,648 | A | 7/1991 | Nicholas | |
| 5,369,034 | A | 11/1994 | Hargett | |
| 5,971,181 | A | 10/1999 | Niedospial | |
| 6,171,293 | B1 | 1/2001 | Rowley | |
| 6,426,046 | B1 | 7/2002 | Cassells et al. | |
| 6,604,561 | B2 | 8/2003 | Py | |
| 6,630,652 | B2 | 10/2003 | Jennings | |
| 6,715,624 | B2 | 4/2004 | Brockwell | |
| 6,945,417 | B2 | 9/2005 | Jansen | |
| 7,032,631 | B2 | 4/2006 | Py | |
| 7,144,739 | B2 | 12/2006 | Jennings | |
| 2002/0134175 | A1 | 9/2002 | Mehra et al. | |
| 2003/0199099 | A1 | 10/2003 | King | |
| 2006/0191594 | A1 | 8/2006 | Py | |

FOREIGN PATENT DOCUMENTS

| | | |
|---|---|---|
| EP | 1 457 261 A2 | 9/2004 |
| EP | 1 618 845 A1 | 1/2006 |

OTHER PUBLICATIONS

Extended Search Report dated Mar. 21, 2011 received from the European Patent Office.
PCT International Search Report, International Application No. PCT/US2008/076037, Date of Mailing: Nov. 25, 2008.
PCT Written Opinion of the ISA, International Application No. PCT/US2008/076037, Date of Mailing: Nov. 25, 2008.

* cited by examiner

*Primary Examiner* — Jyoti Nagpaul
(74) *Attorney, Agent, or Firm* — Scully, Scott, Murphy & Presser, P.C.

(57) ABSTRACT

A reaction bottle which includes a container, container top, container interior a bottle cap removeably attachable to the container top, the bottle cap having a cap top and a cap cavity; a septa attached to the bottle cap and configured to releasably seal the container when the bottle cap is attached to the container top; a needle holder attached to the cap top; a hollow needle attached to the needle holder and located in the cap cavity; a needle conduit in fluid communication with the hollow needle; wherein the septa is configured to deform from an at rest state into a punctured state when pressure within the container interior reaches a first threshold value and the septa deforms into the cavity and is punctured by the hollow needle.

5 Claims, 11 Drawing Sheets

REACTION BOTTLE WITH PRESSURE RELEASE

TECHNICAL FIELD

The present invention relates to the use of a sealed reaction bottle to carry out chemical reactions, particularly sophisticated chemical synthesis reactions. More specifically, the invention relates to a sealed reaction bottle with a safe pressure release mechanism for a pressurized container during such chemical synthesis with or without a heating source.

BACKGROUND

It is conventional to carry out chemical reaction in a glass reaction bottle with an open end. Based on Collision Theory and Activation Energy Theory (minimum kinetic energy), as a rule of thumb, reaction rates for many reactions double or triple for every 10 degree Celsius increase in temperature. Thus heating is often required for increasing rate of chemical reactions or starting and continuing a chemical reaction. When heating is required for a reaction bottle with an open end, a cooling condenser usually is used to restrain the loss of reactants, products, reagents and solvent from the reaction bottle. Even with a cooling condenser, some portion of the reactants may be lost prior to the chemical reaction due to vaporization of the reactants, which may lead to retardation of the desired chemical reaction. Usually the temperature limit for a chemical reaction is the boiling temperature of the reactants and/or solvents used in an open vessel. When higher than boiling temperature is required for certain reactions, or if volatile reactants are involved, or pressure is required for a gaseous reaction, then one may utilize a pressure vessel (such as a glass pressure bottle, a glass pressure tube, and/or a sealed tube), or metal pressure reactor to carry out these reactions. One of the drawbacks associated with using a pressure vessel is safety. Although some pressure vessels are equipped with pressure gauges for monitoring purposes, they usually lack automatic venting systems. Pressure vessels have been known to explode due to unpredictable sudden excess pressure in the pressure vessel. Another drawback is that a pressure vessel may be very difficult to open after a chemical reaction due to internal pressure in the vessel which can cause injury to chemists. One of the drawbacks associated with metal pressure reactors is that they cannot carry out reactions with acidic materials. Acidic materials may be a reactant, product, reagent or solvent (like hydrogen chloride) in a chemical reaction. Acidic materials lead to corrosion, which in turn can cause unpredictable leaks and injury under high temperature and high pressure. In addition a metal pressure reactor should not be used to carry out reactions with reagents that are sensitive to metals. Another drawback to metal pressure reactors, is that they need special skill to use and maintain properly.

Thus, due to the aforementioned disadvantages and drawbacks, there is a need for a reaction bottle that allows for releasing excess pressure safely, while generally maintaining a seal of the reaction bottle during chemical reactions.

SUMMARY

The disclosed invention relates to a reaction bottle comprising: a container, with a container top and a container interior; a bottle cap removeably attachable to the container top, the bottle cap having a cap top and a cap cavity; a septa attached to the bottle cap and configured to releasably seal the container when the bottle cap is attached to the container top;

a needle holder attached to the cap top; a hollow needle attached to the needle holder and located in the cap cavity; a needle conduit in fluid communication with the hollow needle; wherein the septa is configured to deform from an at rest state into a punctured state when pressure within the container interior reaches a first threshold value and the septa deforms into the cavity and is punctured by the hollow needle, and the septa is further configured to return to the at rest state when the pressure within the container reaches a second threshold value and the septa reseals upon being no longer punctured by the hollow needle.

The disclosed invention also relates to a reaction bottle comprising: a container, with a container top and a container interior; a bottle cap removeably attachable to the container top, the bottle cap having a cap top and a cap cavity; a septa attached to the bottle cap and configured to releasably seal the container when the bottle cap is attached to the container top; a needle holder attached to the cap top; a hollow needle attached to the needle holder and located in the cap cavity; a needle conduit in fluid communication with the hollow needle; a pivot member located in the cavity, and attached to the cap top; at least one linearly moveable member located in the cavity and in operational communication with the septa; a pivoting member located in the cavity, the pivoting member having a first end and a second end, the first end in operable communication with the linearly moveable member, and wherein the pivoting member is configured to pivot about the pivot member; an extended member attached to the needle holder, and in operable communication with the second end of the pivoting member; wherein the septa is configured to deform from an at rest state into a second state when pressure within the container interior reaches a first threshold value and the septa deforms and moves the linearly moveable member up towards the cap top, whereupon the pivoting member pivots about the pivot member, and the pivoting member pushes down on the extended member, such that the needle holder and hollow needle are moved down towards the septa, whereupon the septa is punctured by the hollow needle, and the septa is further configured to return to the at rest state when the pressure within the container reaches a second threshold value thus allowing the linearly moveable member to move to its original position thus causing the pivoting member to pivot about the pivot member, and thus move the extended member up towards the cap top, and the needle holder and hollow needle moves up toward the cap top along with the extended member, thus moving the hollow needle away form the septa whereupon the septa reseals upon being no longer punctured by the hollow needle.

In addition, the disclosed invention relates to a reaction bottle comprising: a container, with a container top and a container interior; a bottle cap removeably attachable to the container top; a septa attached to the bottle cap and configured to releasably seal the container when the bottle cap is attached to the container top; a transmitting member in operable communication with the septa; a measurement transducer in operable communication with the transmitting member; a system processor in signal communication with the measurement transducer; an actuator in signal communication with the system processor; an actuating member in operable communication with the actuator; a needle holder in operable communication with the actuating member; a hollow needle attached to the needle holder; a needle conduit in fluid communication with the hollow needle; wherein the septa is configured to deform from an at rest state into a punctured state when pressure within the container interior reaches a first threshold value and the septa deforms such that it exerts a force proportional to the pressure in the container interior on the transmitting member, whereupon the measurement transducer measures the change of the transmitting member, and sends a signal to the processing system, whereupon the processing system sends a signal to the actuator, whereupon the actuator actuates and moves the actuating member and needle holder rand hollow needle such that the hollow needle punctures the septa; the septa is further configured to return to the at rest state when the pressure within the container reaches a second threshold value and the septa returns to the at rest state, and whereupon the measurement transducer measures the change of the transmitting member, and sends a signal to the processing system, whereupon the processing system sends a signal to the actuator, whereupon the actuator actuates and moves the actuating member and needle holder and hollow needle such that the hollow needle is moved away from the septa so that the hollow needle is no longer puncturing the septa and the septa reseals.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
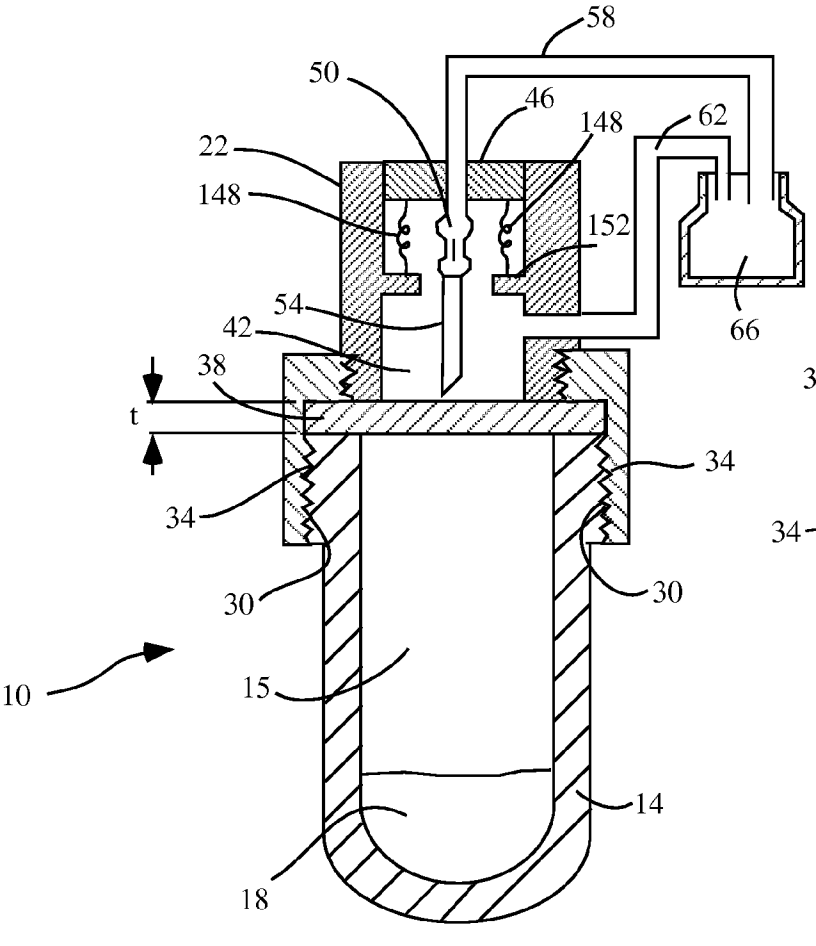
FIG. 1 is a front sectional view of one embodiment of the disclosed reaction bottle.

FIG. 1 is a front sectional view of the disclosed reaction bottle 10. The reaction bottle comprises a container 14. Reactants 18 are shown inside the container 14. The container 14 has a container top 26. A bottle cap 22 is attached to the container top 26. The bottle cap 22 may comprise a threaded interior surface 30 that has a generally cylindrical shape. The top exterior surface of the bottle 10 may have a threaded surface 34 and also a generally cylindrical shape. The cap 22 may thus be removeably attached to the container by mating the threaded interior surface 30 to the threaded surface 34. Located adjacent to the cap 22 and the container 14 is a septa 38. The septa is not attached to the cap 22 or container 14, thus allowing for easy replacement after each reaction, if desired, and also allows for avoidance of contamination. The septa 38 can be replaced after every reaction. When the cap 22 is attached to the container 14, the septa 38 divides a container interior 15 from a cap cavity 42 inside the bottle cap 22. The septa 38 may be made out of a variety of materials, such as but not limited to: Septum, PTFE-faced Silicone, model no. LG-4342, sold by Wilmad-LabGlass, 1002 Harding Highway, Buena, N.J. 08310-0688; PTFE/Red Rubber Septa, PTFE/Silicone/PTFE Septa, Pre-Slit PTFE/Silicone Septa, Pre-Slit PTFE/Red Rubber Septa, PTFE Septa, PTFE/Silicone Septa, Polyethylene Septa, Polypropylene Septa, Viton® Septa, HEADSPACE 20 MM SEPTA, Natural PTFE/White Silicone Septa, Ivory PTFE/Red Rubber Septa, Gray PTFE/Black Butyl Molded Septa all sold by National Scientific Company, Part of Thermo Fisher Scientific, 197 Cardiff Valley Road, Rockwood, Tenn. 37854; PTFE/Red Rubber PTFE/Grey Butyl PTFE/Silicone PTFE/Silicone, PTFE/Silicone, PTFE/Silicone, PTFE/Moulded Butyl, PTFE/Silicone all sold by SMI-LabHut Ltd., The Granary, The Steadings Business Centre, Maisemore, Gloucestershire, GL2 8EY, UK; and LabPure® Vial Septa sold by Saint-Gobain Performance Plastics, 11 Sicho Drive, Poestenkill, N.Y. 12140. Attached to the cap top 46 of the bottle cap 22 is a needle holder 50. Attached to the needle holder, is a non-coring hollow needle 54, configured to be located within the cap cavity 42. The needle holder 50 is in fluid communication with a needle conduit 58. The needle conduit 58 is also in fluid communication with the interior of the hollow needle 54 and the cap cavity 42. An optional emergency discharge conduit 62 may be attached to the bottle cap 22 and also be in fluid communication with the cap cavity 42. An optional reservoir 66 may be in fluid communication with the needle conduit 58. If the optional discharge conduit 62 is present, the reservoir 66 may be also be in fluid communication with the discharge conduit. The septa 38 is shown at an at rest state in FIG. 1. That is, the septa 38 has not been deformed yet by pressure in the container interior 15. In one alternative embodiment, the cap top 46 may move relative to the rest of the cap 22. One or more compression springs 148 are in compression against the underside of the cap top, and one or more cap extending members 152. In this alternative embodiment, a user may push the needle holder 50 down into the septum 38 manually, thereby releasing any pressure in the container 14. This release of pressure is a safety benefit of the disclosed invention. The compression springs 148 will tend to push the needle 54 up and away from the septum 38 after the user has pushed the needle 54.

Figure 2:
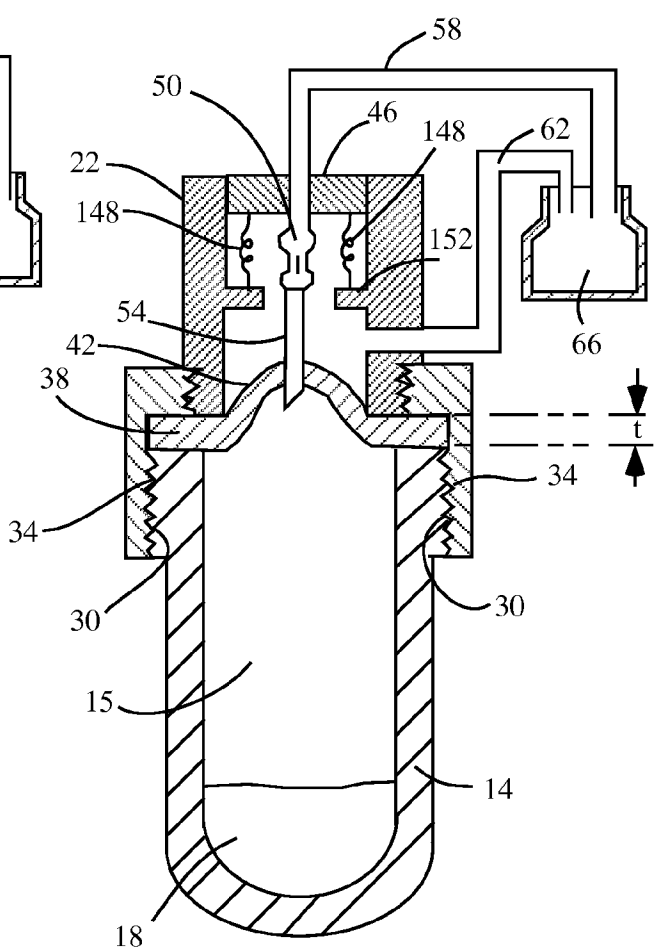
FIG. 2 is a front sectional view of the reaction bottle from FIG. 1, with the septa being deformed.

FIG. 2 shows a front sectional view of the disclosed reaction bottle 10 from FIG. 1. However, in this view, pressure in the container 14 is building up. The pressure may be building up due to chemical reactions occurring in the reactant 18, and/or pressure may be building up due to the interior of the container 14 being heated by microwave radiation or another heat source. If the pressure is great enough in the interior of the container 14, the septa 38 may deform up into the cap cavity 42. The septa may be configured to deform when the pressure in the reaction bottle is between 150-300 psi. Of course, the septa may configured to deform at other pressures, depending on the proposed chemical reactions. Also, the thinner the septa, the more deformation and the less pressure it can hold. As the septa 38 deforms it impinges the needle 54. Once the needle punctures the inner surface 70 of the septa 38, the interior of the hollow needle 54 is in fluid communication with the interior of the container 14. The pressure in the container interior 15 has reached a first threshold value when the pressure causes the septa 38 to become punctured by the hollow needle 54. The amount of pressure required to deform the septa 70 such that the needle 54 punctures the inner surface 70 is dependent on the thickness "t" of the septa and the particular material selected for the septa 38. The septa 38 is shown in a punctured state in FIG. 2.

Figure 3:
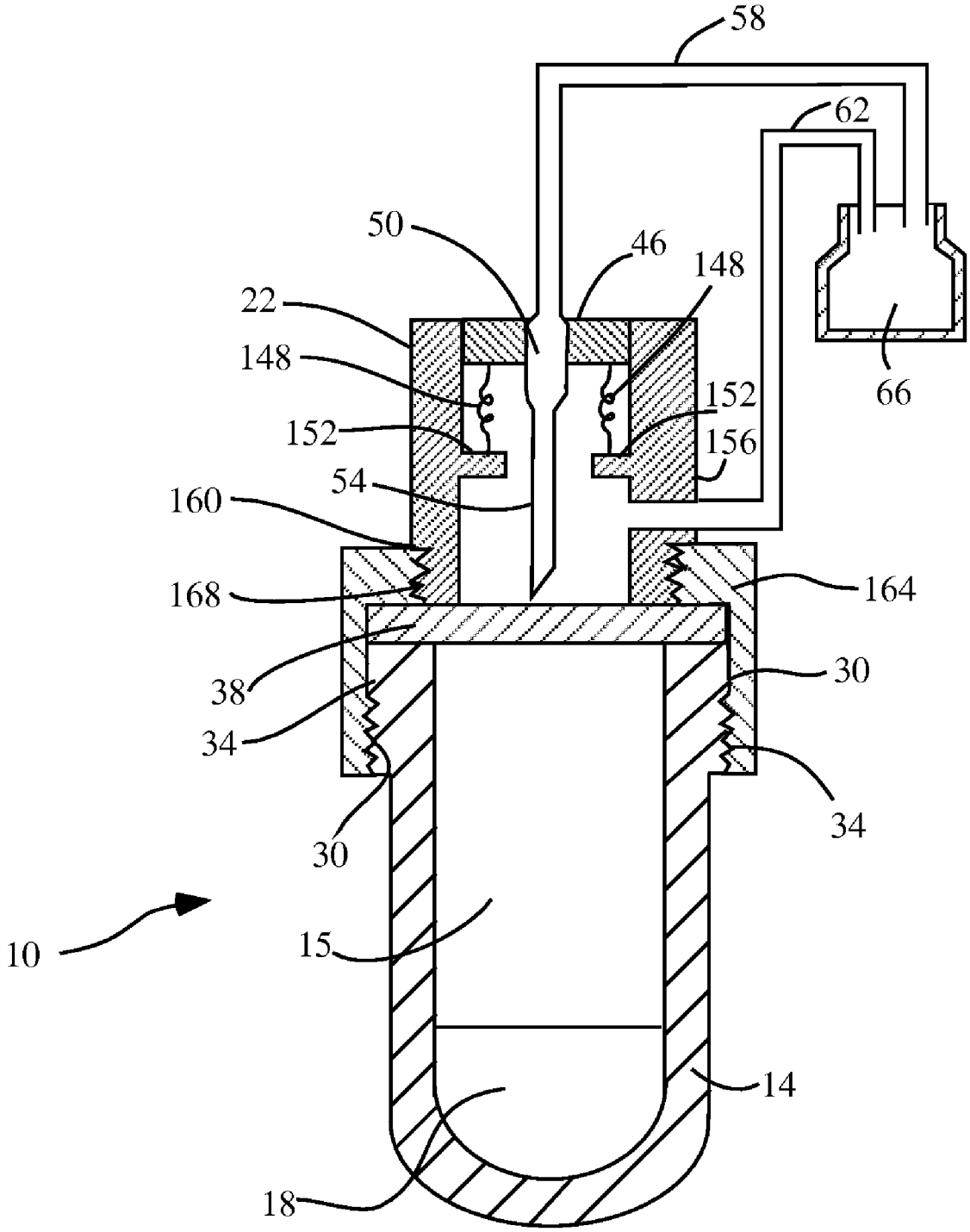
FIG. 3 is a front sectional view of the reaction bottle from FIGS. 1 and 2, with the septa back at an at rest state.

FIG. 3 shows a front sectional view of the disclosed reaction bottle 10 from FIGS. 1 and 2. In this view, the pressure in the container 14 has been released by the puncturing action of the septa 38 impinging against the needle 54, and the pressurized fluid exiting the container through the needle 54, and into the needle conduit 58 and out to the atmosphere or to an optional reservoir 66. Since the pressure in the container 14 has been released, the septa 38 returns to its original shape, and is no longer impinging on the needle 54. The septa 38 is made out of a material, such as but not limited to PTFE-faced Silicone. This material, and others, allow the puncture hole in the septa 38 (from the needle 54) to reseal. The material allows for multiple resealing events. The septa 38 has returned to an at rest state. When the septa 38 has returned to an at rest state, the pressure in the container interior 15 has reached a second threshold value. The septa 38 is designed to reseal many times, usually at least 5 times, and up to 30 times or more, depending on the size of the non-coring needle.

Figure 5:
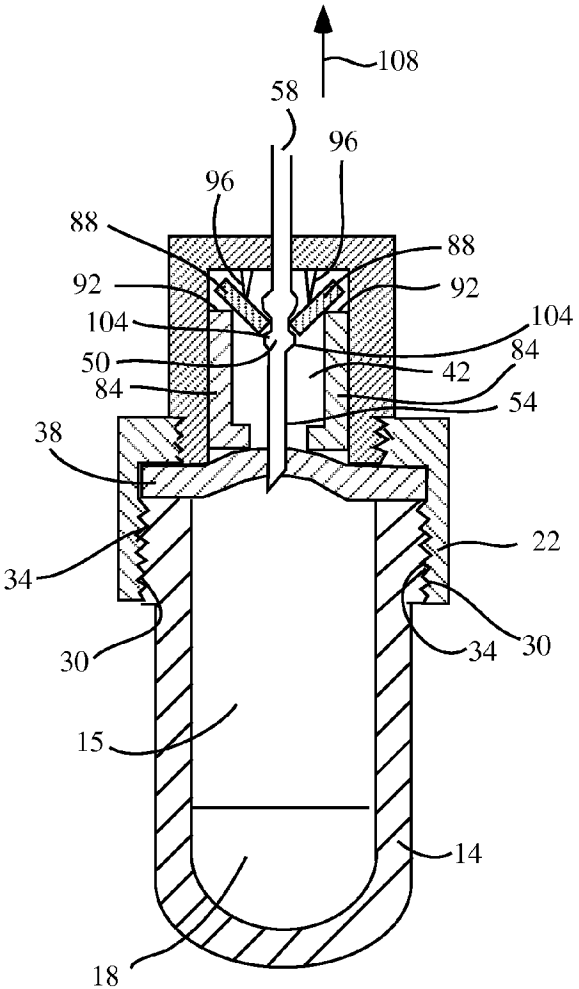
FIG. 5 is a front sectional view of the disclosed reaction bottle from FIG. 4, with the septa deformed and a needle pierced through septa.
Figure 4:
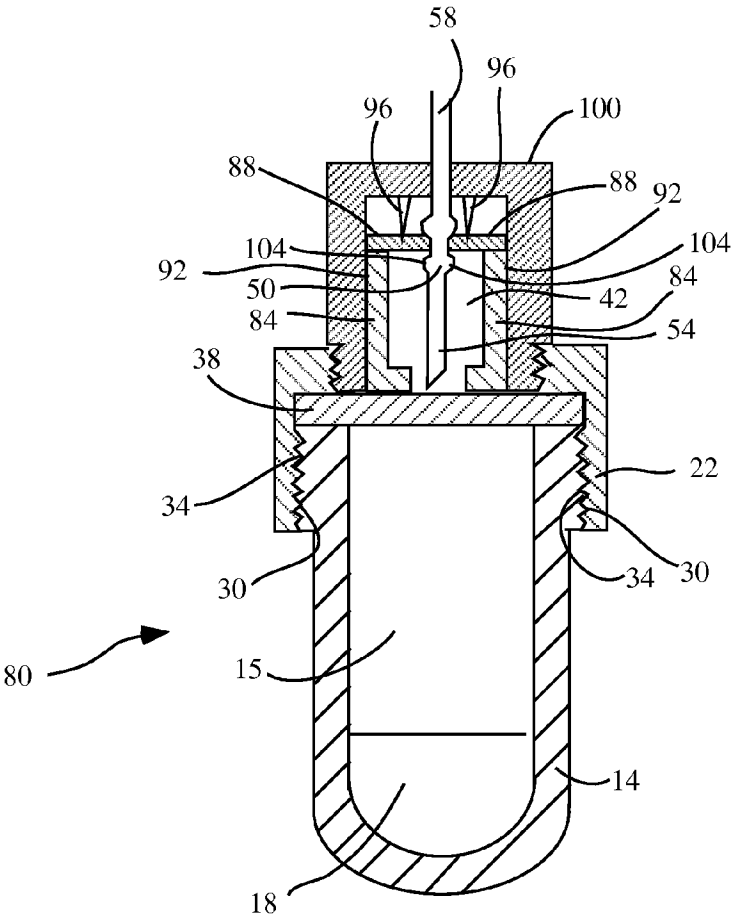
FIG. 4 is a front sectional view of another embodiment the disclosed reaction bottle.

FIG. 4 shows another embodiment of the disclosed reaction bottle. In this embodiment the bottle 80 comprises a bottle cap 22 and a container 14. The bottle cap 22 may comprise a threaded interior surface 30 that has a generally cylindrical shape. The top exterior surface of the bottle 10 may have a threaded surface 34 and also a generally cylindrical shape. The cap 22 may thus be removeably attached to the container by mating the threaded interior surface 30 to the threaded surface 34. Located between the cap 22 and the container 14 is a septa 38. When the cap 22 is attached to the container 14, the septa 38 divides the interior of the container 14 from a cap cavity 42 inside the bottle cap 22. The bottle cap comprises at least one linearly moveable member 84 (this embodiment shows 2 linearly moveable members 84) located in the cap cavity 42. In communication with the top end 92 of the linearly moveable member 84 is a pivoting member 88. The pivoting member 88 is configured to pivot about a pivot member 96. The pivot member is fixed to the top 100 of the bottle cap 22. The pivot may have a spring mechanism to return member 84 to original position after pressure release (the spring mechanism is not shown in this figure). The hollow needle 54 is attached to a needle holder 50. In this embodiment, the needle holder 50 and needle 54 are linearly moveably with respect to the bottle cap, and can move up in the direction of the arrow 108, and down in a direction opposite the arrow 108. Fixed to the needle holder is at least one extended member 104 (in this embodiment, two or more extended members 104 are attached to the needle holder 50). The pivoting member 88 is configured to be in operational communication with the extended member 104. FIG. 5 shows the reaction bottle with pressure developing within the container 14. The pressure causes the septa 38 to deform and move away from the container 14 and into the cap cavity 42. As the septa 38 moves into the cap cavity 42, the septa 38 impinges against the linearly moveable member 84, causing the linearly moveable member 84 to move up in the direction of the arrow 108. The upwards movement of the linearly moveable member 84 causes the pivoting member 88 to pivot about the pivot member 96 such that the pivoting member 88 pushes down (in a direction opposite the arrow 108) on the extended member 104 thus moving the needle holder 50 and needle 54 towards and into the septa 38. In addition, the septa 38 is moving towards the needle 54 as the pressure builds within the container 14. Once the needle 54 punctures the septa 38, pressure is released from the container into the hollow needle and through the needle conduit 58, similar to the operation described with respect to FIGS. 1-3. Not shown in this figure is the needle conduit 58 in fluid communication with an optional reservoir 66 or an optional discharge conduit 62 attached to the bottle cap and in fluid communication with the cap cavity 42, however, those objects may included in other embodiments as modified by those of ordinary skill in the art.

In an alternative embodiment (not shown), which comprises the same mechanism as FIG. 1, a user may push the needle holder 50 through conduit 58 down into the septum 38 manually, thereby releasing any pressure in the container 14 after a reaction.

Figure 6:
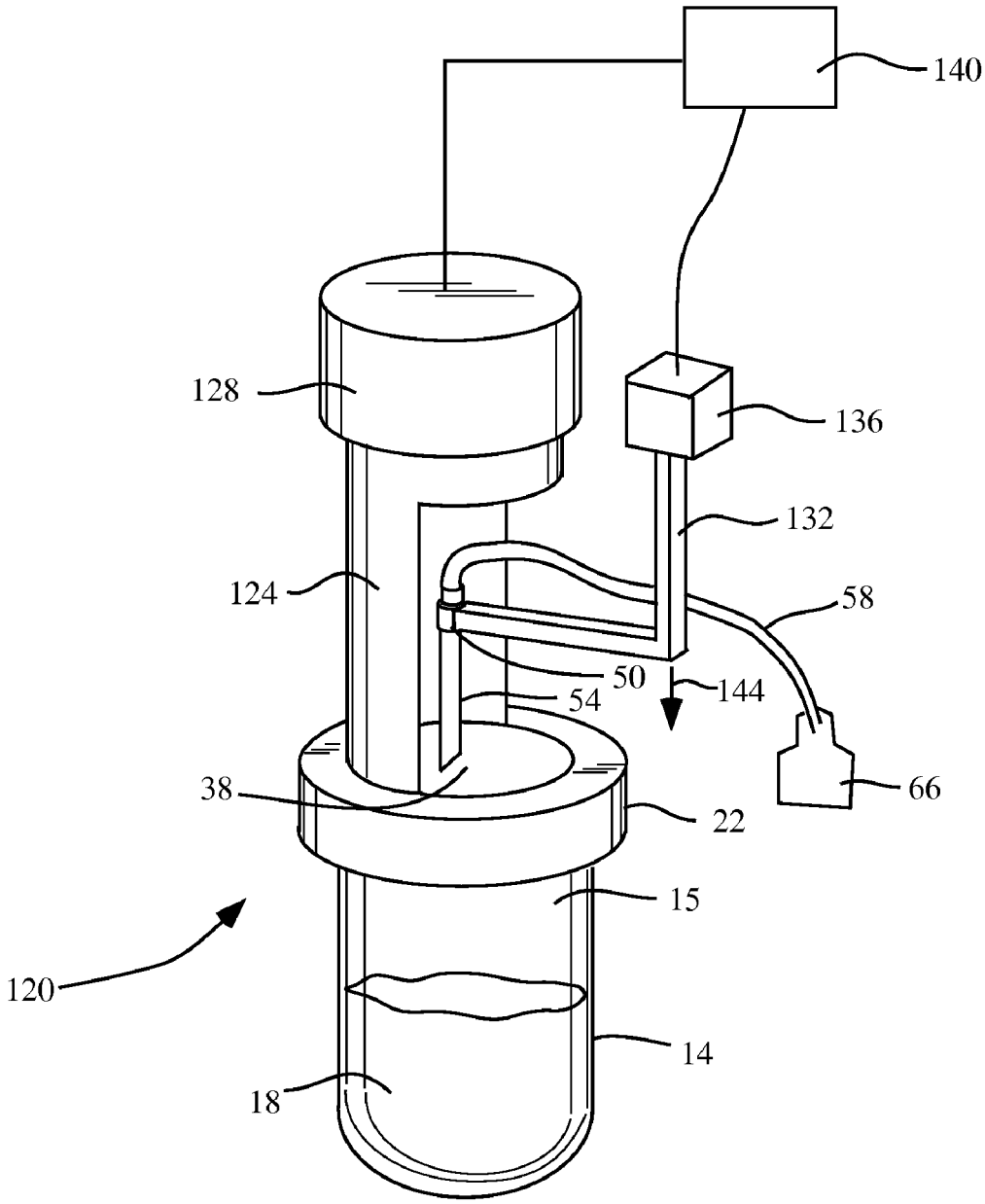
FIG. 6 is a front sectional view of another embodiment of the disclosed reaction bottle.

FIG. 6 discloses another embodiment of the disclosed reaction bottle. In this embodiment, the reaction bottle 120 comprises a bottle cap 22 removeably attached to the container 14. The attachment means may be by mating threaded surfaces as discussed in the previous embodiments. Located between the bottle cap 22 and container 14 is a septa 38. In communication with the septa 38 is a transmitting member 124. The transmitting member is in operational communication with a measurement transducer 128 such as a pressure transducer, for example. The hollow needle 54 is attached to a needle holder 50. A needle conduit 58 is in fluid communication with the interior of the hollow needle 54. The needle holder 50 is in operational communication with an actuating member 132. The actuating member 132 is in operational communication with an actuator 136. A processing system 140 may be in signal communication with the actuator 136 and measurement transducer 128. The processing system 140, may include, but is not limited to a computer system including central processing unit (CPU), display, storage and the like. The computer system may include, but not be limited to, a processor(s), computer(s), controller(s), memory, storage, register(s), timing, interrupt(s), communication interface(s), and input/output signal interfaces, and the like, as well as combinations comprising at least one of the foregoing. For example, the computer system may include signal input/output for controlling and receiving signals from the measurement transducer 128 as described herein. The reaction bottle 120 may operate as follows: as the pressure builds up inside the container 14, the septum 38 attempts to move towards the needle 54. The force of the septum 38 moving up translates through the transmitting member 124 to the measurement transducer 128. The measurement transducer 128 may measure the amount of force transmitted by the transmitting member 124 and communicate that information to the processing system 140. Once the force reaches a threshold value, the processing system 140 activates the actuator 136. The actuator in turn moves the actuating member 132 down in the direction of the arrow 144 a predetermined distance such that the needle 54 punctures the septum 38 and releases the excess pressure through the needle conduit 58 to a the atmosphere or to an optional reservoir 66. In other embodiments, the processing system 140 may be configured to move the needle in a direction opposite the arrow 144 and hold the needle 54 there until the processing system receives information from the measurement transducer 128 that the pressure has gone down below a threshold level, thus causing the needle to move away from the septum 38 and allow the septum to re-seal. In still another embodiment, the measurement transducer may be a movement measurement device that measures the amount of movement the transmitting member 124 moves due to the force of the septum 38. The value of the amount of movement may then be transmitted to the processing system 140. The processing system may then cause the actuator 136 to move the needle into and puncture the septum 38 when the amount of movement reaches a predetermined amount, or if the amount of movement is calibrated to an amount of pressure build up in the container, such that when the pressure reaches a first threshold value, the processing system causes the actuator to move the needle into the septum, in order to puncture the septum 38.

Figure 7:
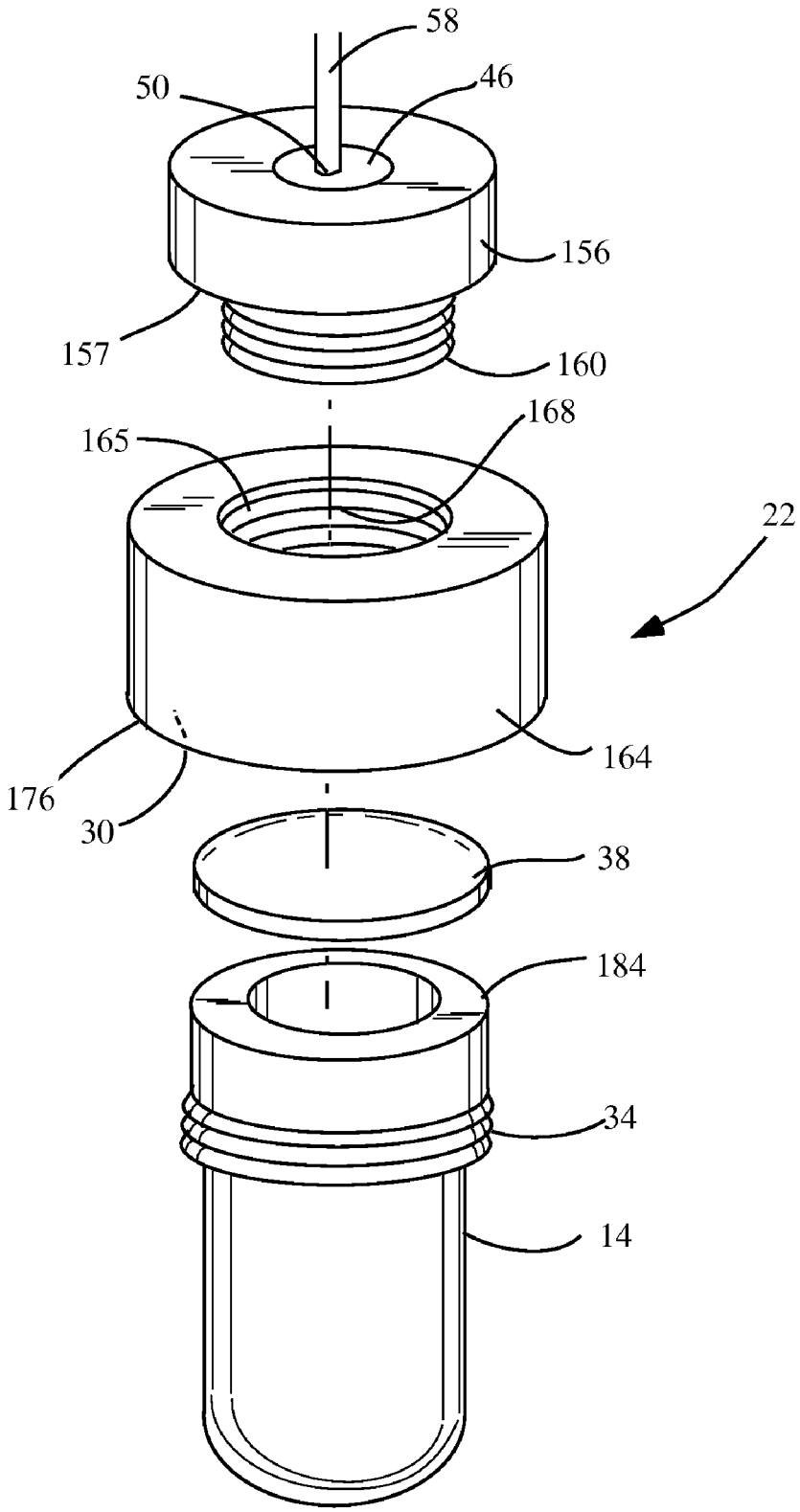
FIG. 7 is a perspective exploded view of the disclosed reaction bottle.

FIG. 7 shows one embodiment of how the cap 22 of the disclosed reaction bottle 10 may be assembled. The cap 22 comprises a top threaded member 156 which allows the cap top 46 (and needle holder 50 and needle 54) to move within the top threaded member 156. The top threaded member 156 has a set of male threads 160. The male threads 160 are configured to mate with the first set of female threads 168 of a lower threaded member 164. The top threaded member 156 has a lip 157 that is of a greater diameter than the threaded opening 165 of the lower threaded member 164. This insures that the top threaded member 156 cannot be screwed too far into the lower threaded member 164. A second set of female threads 172 are located near the bottom 176 of the lower threaded member. The second set of female threads 30 (not visible in this view, but seen in FIGS. 1-3) are configured to mate with a set of male threads 34 located on the container 14. The container 14 has a circular lip 184 located on the top side of the container 14. The septum 38 sits on the lip 184, between the container and the lower threaded member 164, when the lower threaded member 164 is mated with the container 14.

Figure 8:
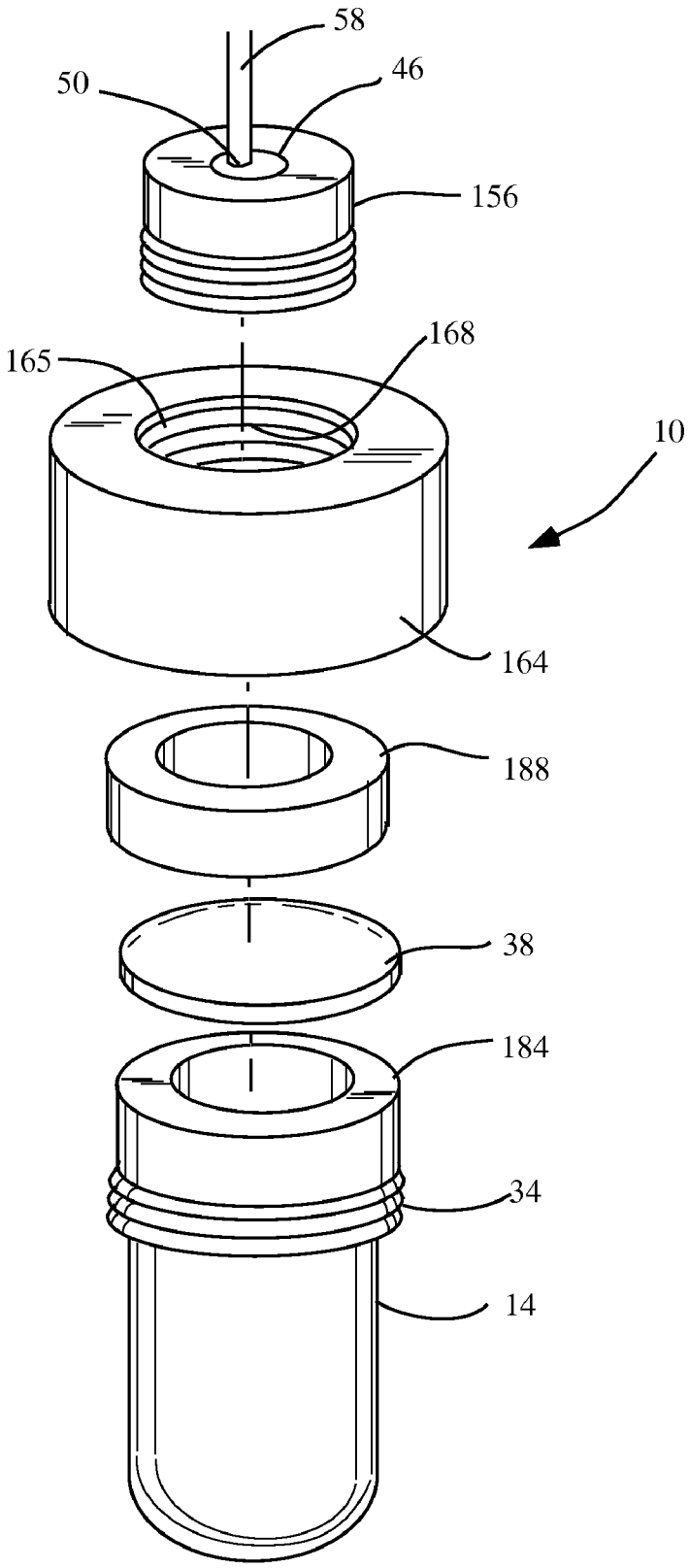
FIG. 8 is a perspective exploded view of a disclosed reaction bottle with a septum cap.
Figure 9:
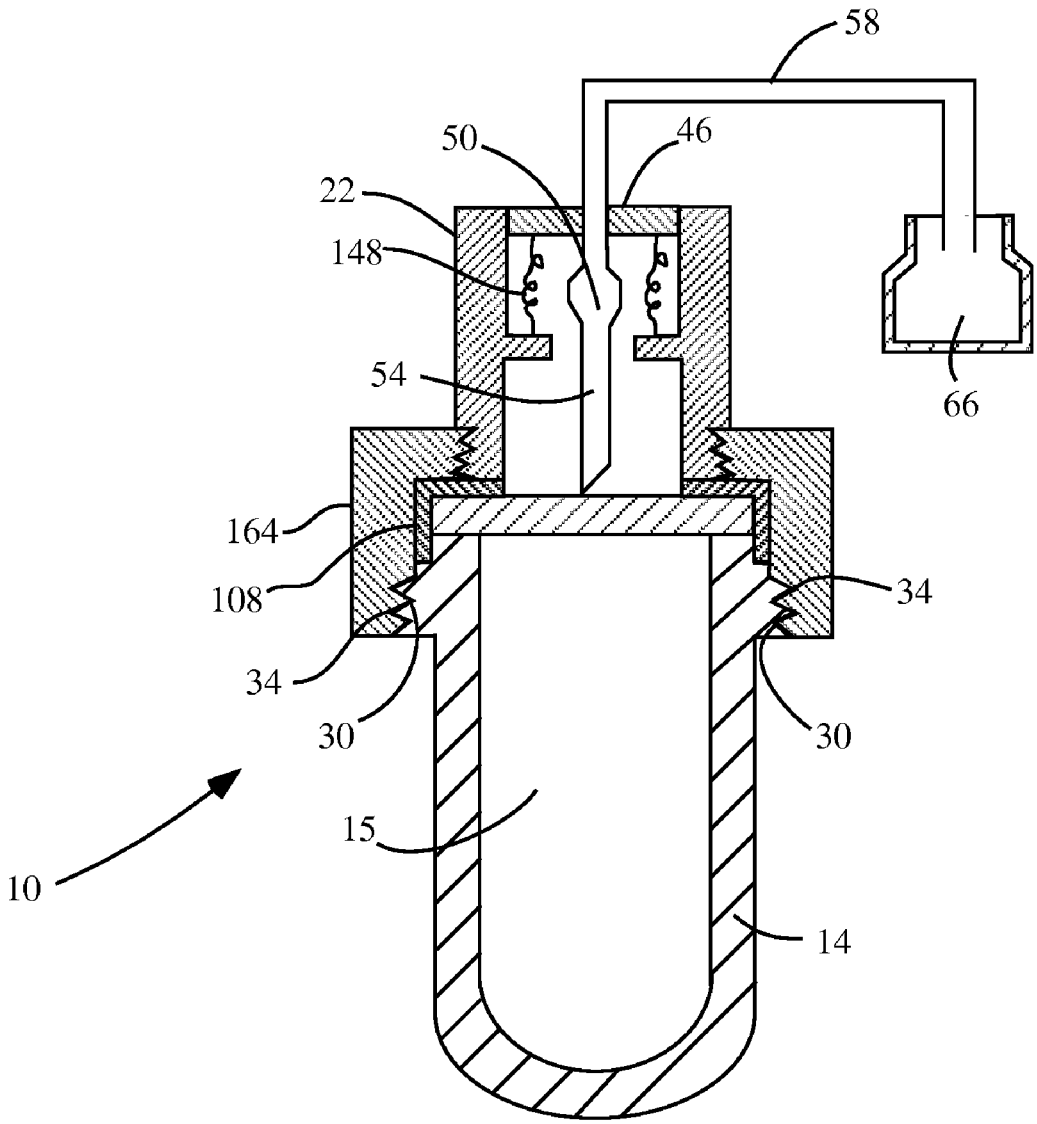
FIG. 9 is a generally front sectional view of the reaction bottle from FIG. 8.

FIG. 8 shows another embodiment of how the cap 22 of the disclosed reaction bottle 10 may be assembled. In this embodiment, there is also a septum cap 188. Another difference is the top threaded member 156 does not have the lip 157, and thus the top threaded member's diameter is generally the same as the diameter of the threaded opening 165 of the lower threaded member 164. In another embodiment, the top threaded member 156 and lower threaded member 164 may manufactured as one piece. This embodiment allows one to simply use the septum cap 188, and septum 38 as a cover for the container 14,without the rest of the cap 22, and needle apparatus. This allows for easy storage, the ability to restrain toxic vapor escaping the container, and/or preventing moisture from entering the container, and safe transport of the container 14 when reactants are in it. FIG. 9 shows a generally cross-sectional view of the embodiment disclosed in FIG. 8.

Figure 10:
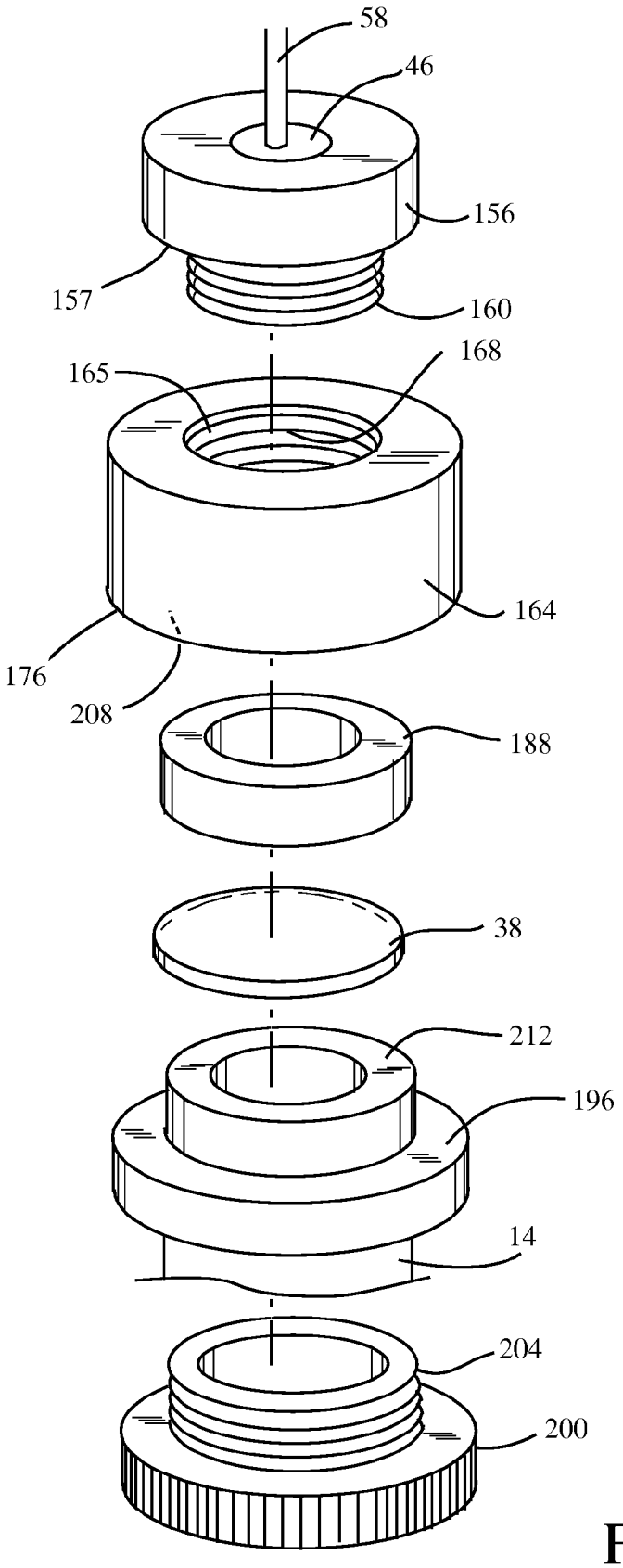
FIG. 10 is a perspective exploded view of a reaction bottle, with a septum cap and where the container has a lip.
Figure 11:
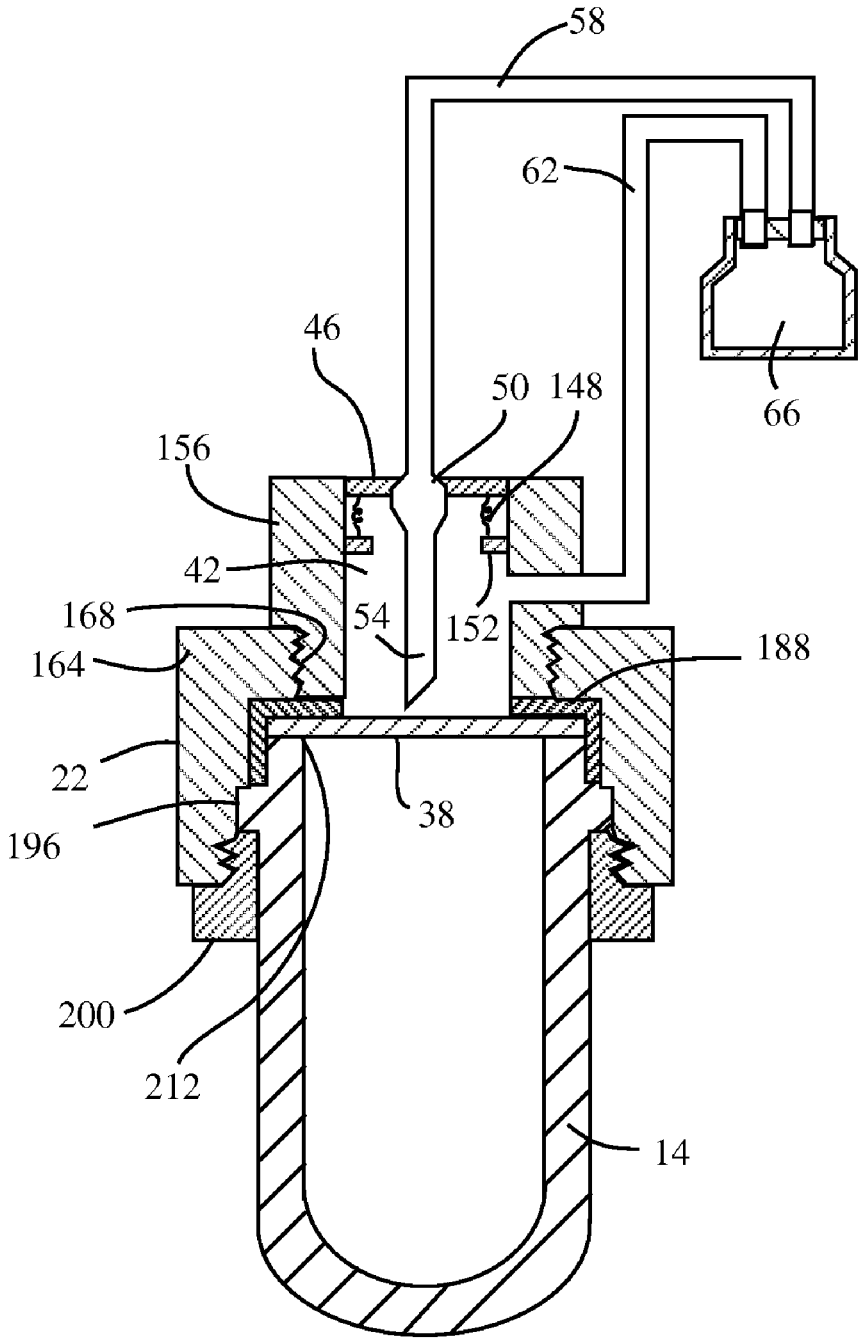
FIG. 11 is a generally front sectional view of the reaction bottle from FIG. 10.

FIG. 10 shows still another embodiment of how the disclosed reaction bottle 192 may be assembled. In this embodiment, the container 14 does not have threads, but does have a circular lip 196. A threaded collar 200 slides onto the container 14 below the lip 196. The collar threads 204 are configured to lie adjacent to the lip 196. The collar threads 204 are configured to mate with a set of female threads 208 located on inside bottom 176 of the lower threaded member 164. As the lower threaded member 164 is threaded onto the collar 200, the cap assembly is held in place by the container lip 196. Again, in this embodiment, there is a septum cap 188. The lip 196 is located a fixed distance away from the container 14 opening 212. FIG. 11 shows a generally cross-sectional view of the embodiment disclosed in FIG. 10.

Figure 12:
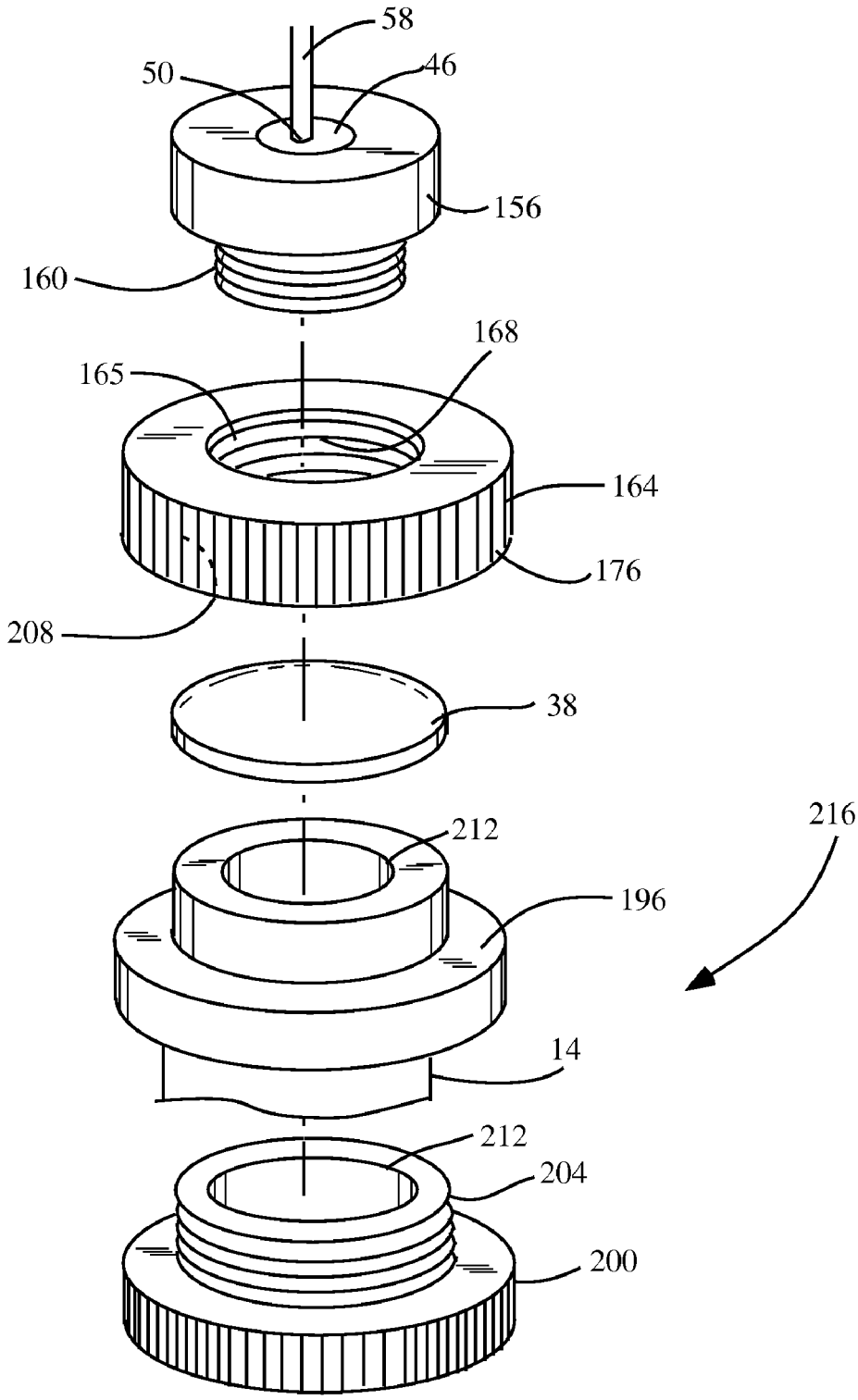
FIG. 12 is a perspective exploded view of a reaction bottle with no septum cap and where the container has a lip located near the container opening.
Figure 13:
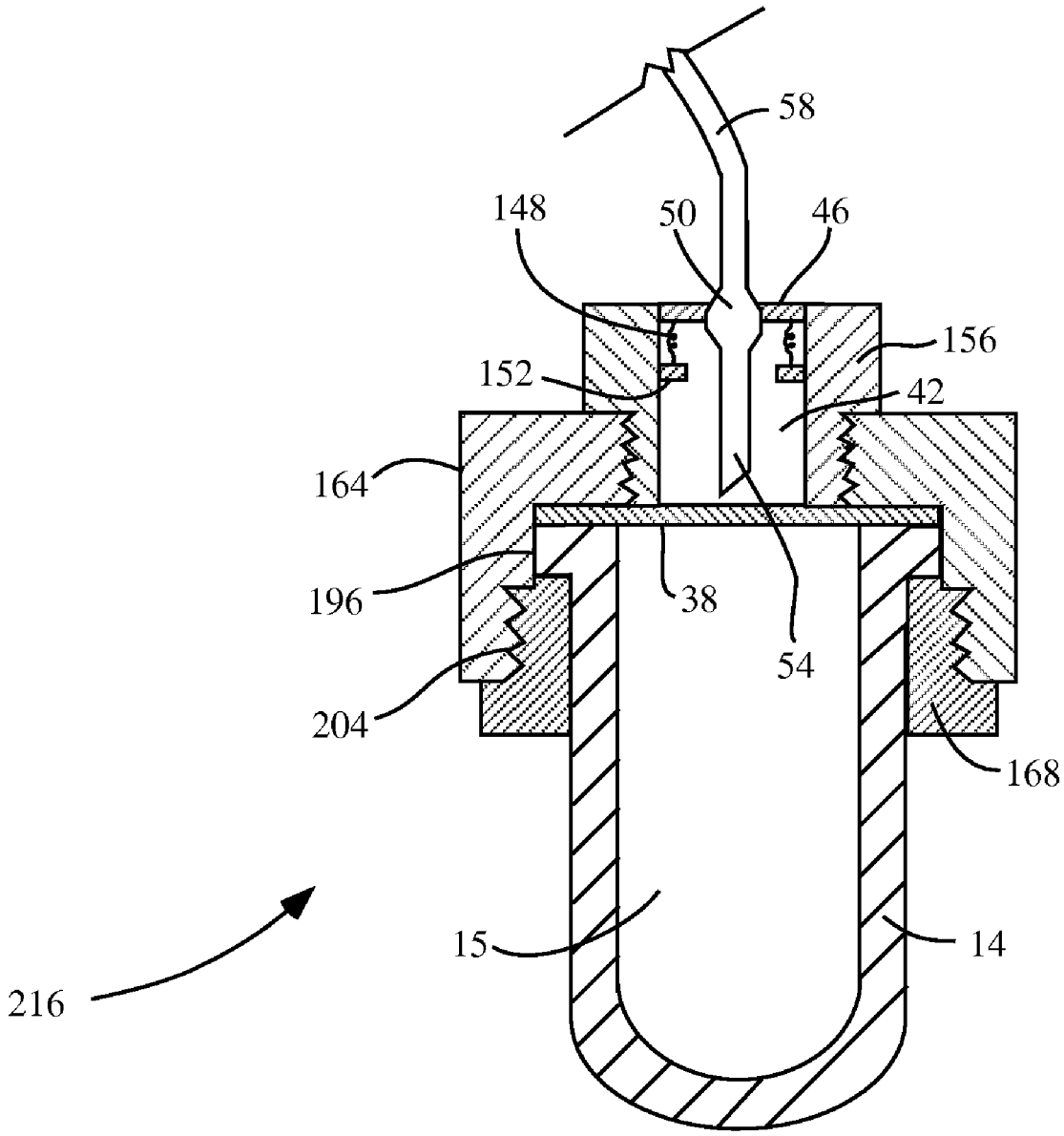
FIG. 13 is a generally front sectional view of the reaction bottle from FIG. 12.

FIG. 12 shows still another embodiment of how the disclosed reaction bottle 216. In this embodiment, the container 14 does not have any threads. The container 14 does have a circular lip 196 located adjacent to the container opening 212. There is no separate septum cap in this embodiment. FIG. 13 shows a cross-sectional view of the embodiment disclosed in FIG. 12.

The advantages of the disclosed reaction bottle include that the bottle may be used with a microwave heating device. The reaction bottle will release pressure buildup in the container, when the hollow needle punctures the septa. The septa will re-seal when the needle is removed from the septa. The reaction bottle has a feed back loop, in that when pressure begins to go down, the septa will return to its original shape, and move away from the needle, at which time the septa will reseal. The reaction bottle may be used with a pressure detection transducer and a processing system. The reaction bottle is safer than reaction bottles without a pressure relief component. Compared to open vessels, the disclosed sealed reaction vessel provides following advantages for chemical reactions: a reaction can be finished in minutes instead of hours at higher temperature than boiling point of solvent; energy savings by reducing heating time from hours to minutes; energy saving by eliminating cooling condenser that is run by continuous tap water for hours; work efficiency through reducing reaction time.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A reaction bottle, comprising:

a container, with a container top and a container interior;

a bottle cap removeably attachable to the container top, the bottle cap having a cap top and a cap cavity;

a septa attached to the bottle cap and configured to releasably seal the container when the bottle cap is attached to the container top;

a needle holder attached to the cap top;

a hollow needle attached to the needle holder and located in the cap cavity;

a needle conduit in fluid communication with the hollow needle;

a pivot member located in the cavity, and attached to the cap top;

at least one linearly moveable member located in the cavity and in operational communication with the septa;

a pivoting member located in the cavity, the pivoting member having a first end and a second end, the first end in operable communication with the linearly moveable member, and wherein the pivoting member is configured to pivot about the pivot member; and an extended member attached to the needle holder, and in operable communication with the second end of the pivoting member;

wherein the septa is configured to deform from an at rest state into a second state when pressure within the container interior reaches a first threshold value and the septa deforms and moves the linearly moveable member up towards the cap top, whereupon the pivoting member pivots about the pivot member, and the pivoting member pushes down on the extended member, such that the needle holder and hollow needle are moved down towards the septa, whereupon the septa is punctured by the hollow needle, and the septa is further configured to return to the at rest state when the pressure within the container reaches a second threshold value thus allowing the linearly moveable member to move to its original position thus causing the pivoting member to pivot about the pivot member, and thus move the extended member up towards the cap top, and the needle holder and hollow needle moves up toward the cap top along with the extended member, thus moving the hollow needle away form the septa whereupon the septa reseals upon being no longer punctured by the hollow needle.

2. The reaction bottle of claim 1, further comprising:

a reservoir in fluid communication with the needle conduit.

3. The reaction bottle of claim 1, further comprising:

a discharge conduit attached to the bottle cap and in fluid communication with the cavity.

4. The reaction bottle of claim 3, further comprising:

a reservoir in fluid communication with the discharge conduit and the needle conduit.

5. A reaction bottle comprising:

a container, with a container top and a container interior;

a bottle cap removeably attachable to the container top;

a septa attached to the bottle cap and configured to releasably seal the container when the bottle cap is attached to the container top;

a transmitting member in operable communication with the septa;

a measurement transducer in operable communication with the transmitting member;

a system processor in signal communication with the measurement transducer;

an actuator in signal communication with the system processor;

an actuating member in operable communication with the actuator;

a needle holder in operable communication with the actuating member;

a hollow needle attached to the needle holder; and a needle conduit in fluid communication with the hollow needle;

wherein the septa is configured to deform from an at rest state into a punctured state when pressure within the container interior reaches a first threshold value and the septa deforms such that it exerts a force proportional to the pressure in the container interior on the transmitting member, whereupon the measurement transducer measures the change of the transmitting member, and sends a signal to the processing system, whereupon the processing system sends a signal to the actuator, whereupon the actuator actuates and moves the actuating member and needle holder rand hollow needle such that the hollow needle punctures the septa, the septa being further configured to return to the at rest state when the pressure within the container reaches a second threshold value and the septa returns to the at rest state, and whereupon the measurement transducer measures the change of the transmitting member, and sends a signal to the processing system, whereupon the processing system sends a signal to the actuator, whereupon the actuator actuates and moves the actuating member and needle holder and hollow needle such that the hollow needle is moved away from the septa so that the hollow needle is no longer puncturing the septa and the septa reseals.

* * * * *